United States Patent [19]

Schwarz

[11] Patent Number: 4,696,339

[45] Date of Patent: Sep. 29, 1987

[54] OIL COOLER

[75] Inventor: Gebhard Schwarz, Stuttgart, Fed. Rep. of Germany

[73] Assignee: Suddeutsche Kuhlerfabrik Julius Fr. Behr, GmbH & Co. KG, Stuttgart, Fed. Rep. of Germany

[21] Appl. No.: 793,123

[22] Filed: Oct. 30, 1985

[30] Foreign Application Priority Data

Nov. 2, 1984 [DE] Fed. Rep. of Germany ..... 3440064

[51] Int. Cl.[4] ..... F28D 7/00; F28E 9/16

[52] U.S. Cl. ..... 165/51; 165/119; 165/158; 165/916; 123/41.33

[58] Field of Search ..... 184/104.2, 104.3; 165/158, 119, 916, 51, 173, 175, 149; 123/41.33, 196 AB, 196 A

[56] References Cited

U.S. PATENT DOCUMENTS

| | | | |
|---|---|---|---|
| 1,168,368 | 1/1916 | Zimmermann | 184/104.3 |
| 1,776,726 | 9/1930 | Gross | 184/104.3 |
| 1,981,089 | 11/1934 | Carpenter | 165/119 |
| 1,992,130 | 2/1935 | Rose | 165/173 |
| 3,420,295 | 1/1969 | Gotz | 165/51 |
| 3,743,011 | 7/1973 | Frost | 165/916 |
| 3,830,289 | 8/1974 | Olson | 165/51 |
| 4,271,901 | 6/1981 | Buchmuller | 165/916 |
| 4,580,625 | 4/1986 | Yamanaka et al. | 165/916 |

FOREIGN PATENT DOCUMENTS

| | | | |
|---|---|---|---|
| 2353419 | 4/1975 | Fed. Rep. of Germany | 165/173 |
| 2357992 | 5/1975 | Fed. Rep. of Germany | 165/173 |
| 1934193 | 9/1978 | Fed. Rep. of Germany | 123/196 AB |
| 2736615 | 2/1979 | Fed. Rep. of Germany | 165/51 |
| 720754 | 2/1932 | France | 123/196 AB |
| 643683 | 9/1950 | United Kingdom | 165/51 |

*Primary Examiner*—William R. Cline
*Assistant Examiner*—John K. Ford

[57] ABSTRACT

An oil cooler arrangement for internal-combustion engines is described which is used in particular for installation between the engine and an oil filter. The heat exchange space of this oil cooler through which the oil flows is formed as a housing chamber into which a heat exchange body is tightly placed through which the coolant, in particular, water, flows. The heat exchange body includes many parallel pipes, the ends of which are held in the bottoms of two oppositely disposed coolant collecting spaces. This design permits the production of oil coolers without soldering or welding processes. The water flow-through through the parallel pipes is also exactly defined.

11 Claims, 4 Drawing Figures

OIL COOLER

BACKGROUND AND SUMMARY OF THE INVENTION

This invention relates to an oil cooler for internal-combustion engines. More specifically, the invention relates to an oil cooler for installation between the engine and an oil filter and having at least one heat exchange space through which the oil flows that is to be cooled, and one heat exchange space through which the coolant flows, both spaces bordering on one another. In preferred contemplated embodiments, water serves as the coolant.

Oil coolers of this type are known in the form of disk coolers such as described in German Published Examined Patent Application (DE-AS) No. 28 43 432. In the case of these disk coolers, several hollow disks are arranged behind one another and in parallel to one another in a housing through which the cooling water flows, the oil flowing through said disks and the cooling water flowing around them. A disadvantage in the case of these disk coolers is the relatively expensive type of production requiring soldering and welding processes. Another disadvantage is the relatively heavy weight and the cooling performance that is not sufficient for some applications.

An oil cooler is known from German Patent (DE-PS) No. 19 34 193 where the hot oil coming from the internal-combustion engine is guided through a pipe coil arranged on the interior of a housing through which the water flows. However, this type of construction has the disadvantage of an expensive production because there also, the pipe coil must be attached by welding or soldering.

This invention is based on the objective of providing and oil cooler of the initially mentioned type that can be produced in a simpler way and without a soldering or welding process.

This objective is achieved by designing the heat exchange space through which the oil flows as a housing chamber into which a heat exchange body is inserted tightly. The coolant flows through the heat exchange body, which comprises a plurality of parallel pipes, the ends of which are held in respective bottom end walls of coolant collecting spaced disposed at opposite ends of the pipes. Such heat exchange bodies, which are known from water - air coolers with repect to their principles, can be inserted in a simple way into the housing chamber by means of sealing means or similar devices without any soldering or welding processes. For their production, they also do not require a soldering process. Another advantage is that the water flow is exactly defined by the parallel pipes, which is not ensured in the case of the known constructions.

The whole construction of the oil cooler may be designed according to the invention to be very simple when the coolant collecting spaces are formed by the two bottom end walls that are opposite one another and one fitted hood-shaped water box respectively. It is then possible to develop the housing chamber as a frame that is open at two sides in which the water boxes are inserted by sealing means and are in each case held by a flanged edge of the housing chamber. No soldering process is required for this purpose.

In a manner that is known per se, the pipes provided in the heat exchange body may be those having a circular-ring-shaped cross-section, the ends of which are sealed in the coolant space bottom end walls by expanding and/or by the insertion of sealing rings. The pipes, in turn are connected to form a pipe fin or rib block via a plurality of ribs or plates which extend essentially in planes located perpendicularly to the longitudinal direction of the pipes and are surrounded by flowing oil. The pipe rib block with the coolant space bottom end walls provided at both of its end sides, can be clamped tightly into the housing chamber before the two water boxes are fitted on. In this case, a surrounding sealing means is preferably provided between the coolant space bottom end walls and for the housing chamber. By the expanding of the pipe ends, the coolant space bottom end walls are pulled together and get jammed at the edge of the housing chamber.

In certain preferred embodiments, the housing chamber has a through-bore extending transversely to the pipes of the heat exchange body through which a hollow connecting piece can be guided in a simple way, the one end of which connecting piece can be screwed to the oil filter and the other to the engine. In this manner, the housing chamber can rest against the engine via a surrounding sealing means in which case oil inlet openings may be provided within the area of this sealing means, and the space closed off by the sealing means is connected to at least one connecting opening to the engine. As a result, the hot engine oil enters the housing chamber through the oil inlet openings, flows past the pipes through which the coolant, such as water, flows, and past the plates resting on them and advantageously, via a plurality of outlet openings, enters into an annulus of the filter. These outlet openings in turn lead into a space which is delimited with respect to the oil filter by a surrounding sealing means. The two spaces enclosed by the sealing means on both sides of the housing chamber may be formed respectively by one surrounding edge of the housing chamber at the front side of which the sealing means is arranged in each case.

In order to be able to arrange the connecting piece as well as the discharge piece for the coolant on the same side of the oil cooler for purposes of installation, one of the two water boxes is preferably provided with both connecting pieces and a separating wall between the inlet and the discharge piece, so that the coolant can flow only through one part of the pipes in one direction, and after the deflection in the other water box, then through the second part of the pipes back again into the first water box.

Further objects, features, and advantages of the present invention will become more apparent from the following description when taken with the accompanying drawings(s) which show, for purposes of illustration only, an embodiment in accordance with the present invention.

DETAILED DESCRIPTION OF THE DRAWINGS

Figure 1:
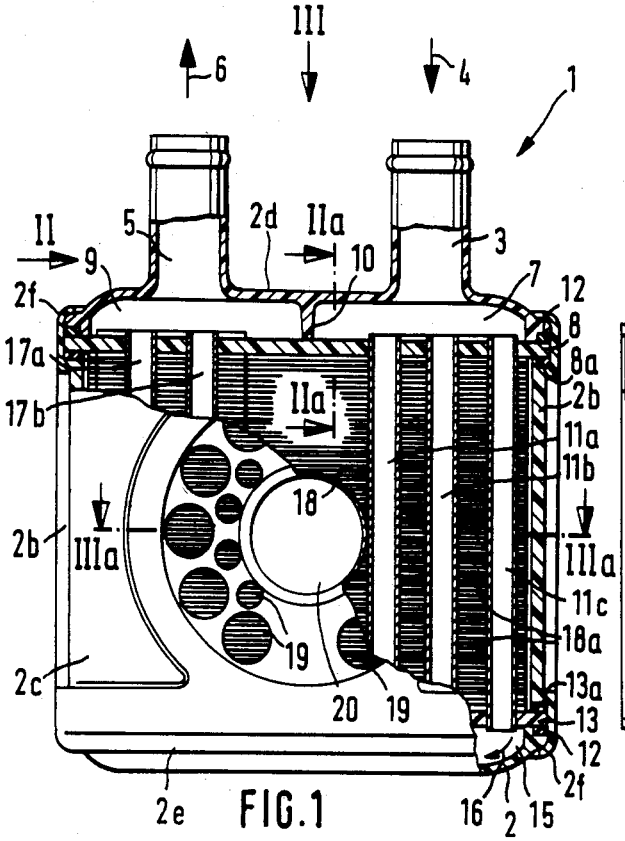
FIG. 1 is a part sectional schematic top view of an oil cooler constructed according to a preferred embodiment of the invention.
Figure 2:
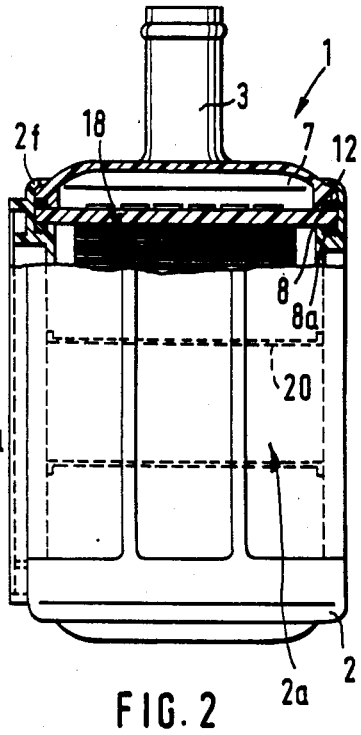
FIG. 2 is a part sectional view of the oil cooler of FIG. 1 taken in the direction of the Arrow II.

The oil cooler shown in FIG. 1 as a whole has the reference number 1. It has a housing chamber 2 which includes a center part 2*a* that is developed essentially as an open frame with two opposing closed front walls 2*b* and two opposing lateral walls 2*c*, into which one hood-shaped water box 2*d* and 2*e* respectively is inserted at the two open sides. The center part 2*a* forms a housing part into which a heat exchange body is inserted in the form of a pipe rib block 18. The pipe rib block 18 in this case consists of several pipes 11*a*, 11*b*, 11*c* or 17*a*, 17*b* arranged in parallel to one another and of plate-shaped ribs 18*a* which are located in planes extending perpendicularly to the axes of the pipes 11*a* to 11*c* and 17*a* and 17*b*. Not shown turbulence inserts may also be placed in the pipe rib block. These plate-shaped ribs 18*a*, in a known manner, enlarge the heat exchange surface. Without soldering, they are connected with the pipes 11*a* to 11*c* or 17*a*, 17*b*, for example, by a widening of the pipes, and are in heat contact with them.

The pipes 11*a* to 11*c* and 17*a* and 17*b* are fitted with their ends into coolant space end walls 8 and 13. After the insertion of the pipe rib block 18, end walls 8 and 13 are placed in the center part 2*a*, with the interposition of one sealing means 13*a* and 8*a*, the end walls 8 and 13 are then jammed against the center part 2*a*. This connection of the end walls 8 and 13 is preferably done by widening the free ends of the pipes 11*a* to 11*c* and 17*a*, 17*b* projecting beyond the end walls 8 and 13 so that, on the one hand, they are pressed tightly into the end walls, and, on the other hand, they press end walls 8 and 13 toward one another and thus against the sealing means 13*a*, 8*a* and the center part 2*a*. The center part 2*a* that is then closed off by the end walls 8 and 13 on both sides is then sealed off toward the outside in each case by means of the hood-shaped water boxes 2*d* and 2*e*.

These water boxes and end walls 8 and 13 form coolant collecting spaces 7, 9 and 15 through which the cooling water guided through a connecting piece 3 in the direction of the Arrow 4 can flow off in the direction of the Arrow 16 to a discharge piece 5 and then from there in the direction of the Arrow 6. Inlet and discharge connecting pieces 3 and 5 are mounted at the water box 2*d* which is also equipped with a separating wall 10 which is fitted tightly on the assigned end wall 8 of the upper (as depicted in FIG. 1) water box. By means of this design, the pipes are divided into two groups in which case the cooling water flows downward into the collecting space 15, through the pipes 11*a* to 11*c*, is deflected there and through the pipes 17*a*, 17*b* reaches the coolant collecting space 9 of the upper water box 2*d* and from there is discharged in the direction of the Arrow 6.

The two water boxes 2*d* and 2*e* are firmly connected with the center part 2*a* by the fact that an edge 2*f* of the center part 2*a* respectively is flanged around an edge of the water boxes 2*d* and 2*e* so that these are pressed against the assigned end walls 8 and 13 and against sealing means 12 which carry out the sealing-off between the water boxes 2*d*, 2*e* and the assigned bottoms 8 and 13. The whole construction of the oil cooler 1 can therefore take place without any soldering or welding process.

The center part 2*a*, on the sides 2*c* extending approximately perpendicularly to the lateral walls 2*b*, is equipped with several openings 19 which in the case of the illustrated embodiment are disigned as bores which permit the access to the interior of the housing chamber 2. On the opposite side, openings 25 of the same design are provided. The openings 19 and 25 each lead into a respective annulus 26*a* and 26*b* which is open toward the outside and is bordered by a surrounding edge 30*a* and 30*b*. An inserted sleeve 21 extends centrally through the housing chamber 2, the sleeve 21 being guided through corresponding openings in the lateral walls 2*c* and in the pipe rib block 18. This sleeve 21 and the openings 19 and 25 are intended for the flow-through of the oil. In the illustrated embodiment, the oil flows in the direction of the Arrow 22 through the openings 25 into the housing chamber, flows around the pipe rib block 18 and in the direction of the Arrow 23 flows again out of the openings 19, flows through an oil filter and then, in the direction of the Arrow 24*a* and 24*b*, through the sleeve 21 returns to the engine, as is shown in FIGS. 3 and 4.

Figure 3:
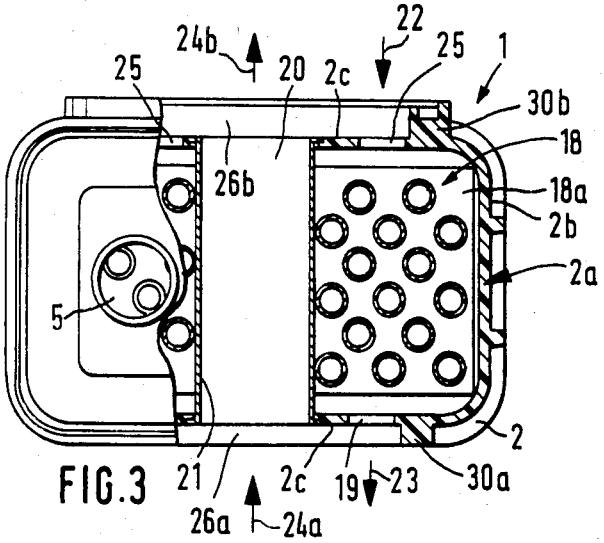
FIG. 3 is a part sectional view of the oil cooler of FIG. 1, taken in the direction of the Arrow III.
Figure 4:
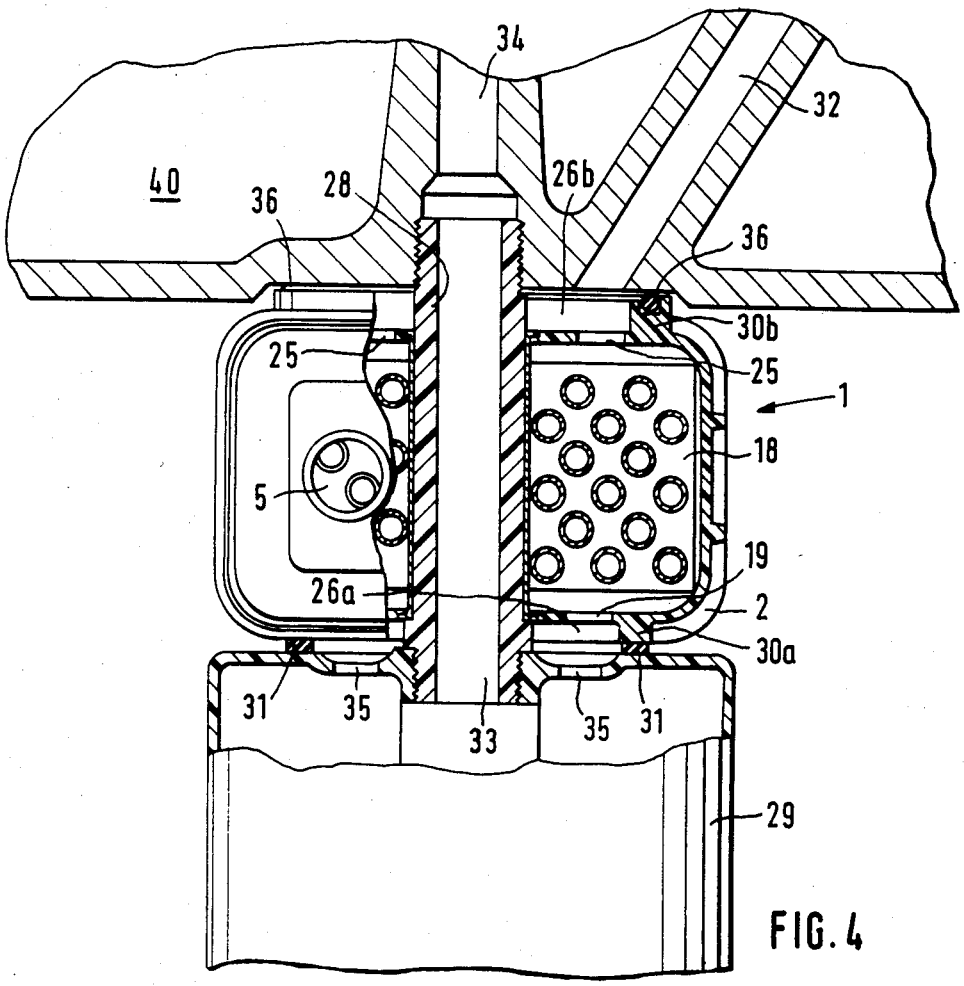
FIG. 4 is a part sectional view of the oil cooler of FIGS. 1-3, similar to FIG. 3 but showing the oil cooler in the installed condition between an engine block and an oil filter.

FIG. 4 shows the oil cooler in the representation according to FIG. 3 but in the installed condition, in which case the connecting parts are also shown as partially sectioned. The engine block 40 of the internal-combustion engine, shown as a segment, is equipped with a bore 34 which, at its extreme end, has an internal thread. A hollow connecting piece 28 is screwed into said internal thread, said connecting piece 28 being pushed through the opening 20 of the oil cooler 1. On its side that is opposite the engine block 40, an oil filter 29 is screwed onto the connecting piece 28. The oil cooler 1, with respect to the engine block 40, is sealed off by a surrounding sealing means 36 which is placed in a groove in the edge 30*b*. With respect to the oil filter 29, the oil cooler 1 is sealed off by a surrounding sealing means 31 which on the outside rests against the front surface of the edge 30*a*. The oil filter 29 has openings 35 through which the oil flowing out of the openings 19 (FIG. 3) in the direction of the Arrow 23 can enter the filter 29, is deflected there and through the opening 33 of the connecting piece 28 arrives at the bore 34 of the engine block 40 and from there is led back to the engine. The uncleaned and hot engine oil, via a connecting duct 32 in the engine block 40, arrives in the space 26*b*, from there through the openings 25 it arrives in the housing chamber 2 and, as already described in regard to FIG. 3, is led past the pipe rib block 18 through which cooling water flows.

Because of its construction, the new oil cooler has advantages with respect to production technology. However, it also has a considerably larger cooling capacity and a significantly lower passage resistance for the oil which therefore can be led through the cooler and the filter in larger quantities.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An oil cooler arrangement for an internal combustion engine which is interposable between an engine and an oil filter, comprising:

housing chamber means for housing said oil cooler having a rectangular box-shaped center part, a ribbed pipe block tightly held in the box-shaped center part, said pipe block including a plurality of parallel pipes connected to one another by continuous ribs extending transverse to the longitudinal direction of the pipes, said pipes providing a coolant flow path therethrough for cooling said pipes and ribs which in turn cool oil flowing around the pipes and ribs in the pipe block, and coolant collecting space means formed at one end of the pipe block for communicating coolant with the pipes, said coolant collecting space means being formed by a coolant space end wall penetrated by the pipes and a hood-shaped coolant box, said ribbed pipe block being insertable into said box-shaped center part, said box-shaped center part including a side wall and an integral flanged edge for clampingly holding the ribbed pipe block in assembled condition, said flanged edge extending over a portion of said coolant box to clamp said coolant space end wall between said coolant box and said side wall.

2. An oil cooler arrangement according to claim 1, wherein coolant collecting space means are formed at both opposite ends of the pipe block, each coolant collecting space means being formed by a respective coolant space end wall penetrated by the pipes and a hood-shaped coolant box facing the respective end wall, said box-shaped center part including an integral flanged edge at each end thereof for clampingly holding the ribbed pipe block in assembled condition.

3. An oil cooler arrangement according to claim 2, wherein the coolant space end walls and the flanged edge are configured such that the end walls are edges between the hood-shaped coolant box and a said side wall of the box-shaped center part.

4. An oil cooler arrangement according to claim 1, wherein a means forming an opening is provided that traverses the ribbed pipe block transversely to the direction of the pipes and is sealed off with respect to the housing chamber means, said opening serving as a fastening opening.

5. An oil cooler arrangement according to claim 4, wherein a hollow connecting piece penetrating the opening is provided, one end of said connecting piece being threadably connectable to an engine block and the other end being threadably connectable to an oil filter, said connecting piece being a return conduit means for returning oil from the filter to the engine.

6. An oil cooler arrangement according to claim 5, wherein the housing chamber means is sealed against the engine block by a first surrounding sealing means, said housing chamber means having oil inlet openings within the range of this sealing means, the space closed off by the first sealing means being connected to a connecting duct to the engine block.

7. An oil cooler arrangement according to claim 6, wherein the housing chamber means is sealed against the oil filter with a second surrounding sealing means, and wherein the second sealing means delimits a space of the housing chamber into which a plurality of oil outlet openings leads via which the oil can enter into an annulus of the oil filter.

8. An oil cooler arrangement according to claim 7, wherein the two spaces enclosed by the first and second sealing means are formed by one surrounding edge of the housing chamber respectively, at the front side of which one sealing means respectively is arranged.

9. An oil cooler arrangement according to claim 2, wherein one of the coolant boxes is equipped with inlet and outlet pieces for the coolant and with a separating wall extending between them, said separating wall tightly resting against the respective facing coolant space end wall.

10. An oil cooler arrangement according to claim 3, wherein a means forming an opening is provided that transverses the ribbed pipe block transversely to the direction of the pipes and is sealed off with respect to the housing chamber means, said opening serving as a fastening opening.

11. An oil cooler arrangement according to claim 10, wherein a hollow connecting piece penetrating the opening is provided, one end of said connecting piece being threadably connectable to an engine block and the other end being threadably connectable to an oil filter, said connecting piece being a return conduit means for returning oil from the filter to the engine.

* * * * *